United States Patent [19]

Owen

[11] Patent Number: 4,925,099

[45] Date of Patent: May 15, 1990

[54] SUNBATHER SPRINKLER APPARATUS

[76] Inventor: Ronny C. Owen, 1147 Pin Oak Cir., Niceville, Fla. 32578

[21] Appl. No.: 280,986

[22] Filed: Dec. 7, 1988

Related U.S. Application Data

[63] Continuation-in-part of Ser. No. 111,309, Oct. 22, 1987, abandoned.

[51] Int. Cl.[5] ..... A47C 7/74

[52] U.S. Cl. ..... 239/289; 128/366

[58] Field of Search ..... 239/289, 269, 562, 577, 239/279, 207, 211; 4/615, 601, 611, 590, 569; 128/366, 377, 378; 297/180, 184, 217

[56] References Cited

U.S. PATENT DOCUMENTS

| | | | |
|---|---|---|---|
| 615,486 | 12/1898 | Jendis | 239/562 X |
| 1,203,579 | 11/1916 | Callon | 4/569 |
| 2,286,933 | 6/1942 | Royal | 239/578 X |
| 2,303,478 | 12/1942 | McLean | 239/578 X |
| 2,770,812 | 11/1956 | Whiteside | 239/289 |
| 3,214,133 | 10/1965 | Rodgers et al. | 239/562 X |
| 3,625,434 | 12/1971 | Kitover | 239/289 |
| 3,688,775 | 9/1972 | Raymann | 128/366 |
| 4,151,618 | 5/1979 | Carpenter | 239/289 X |
| 4,294,409 | 10/1981 | Larsen | 239/577 |
| 4,548,357 | 10/1985 | Schmidt | 239/289 |
| 4,648,143 | 3/1987 | Breaux | 239/289 X |
| 4,765,542 | 8/1988 | Carlson | 239/289 |

*Primary Examiner*—Andres Kashnikow

*Attorney, Agent, or Firm*—Arthur G. Yeager

[57] ABSTRACT

A sprinkler device for use with either fixed or adjustable lawn chairs utilizes a U-shaped sprinkler tube with sprinkler holes supplied with water through a garden hose via a three-port threaded T-connector. The flow of water into the sprinkler tube is controlled by a spring-action to close ball valve opened by pulling a lanyard attached to an arm of the ball valve control handle which, in turn, operates as a lever against the spring bias. The legs of the U-shaped tubing can either be rigid lengths or rigid sections having flexible connectors positioned to be aligned with the pivot points of an adjustable chair at the back rest and/or leg rest sections.

21 Claims, 3 Drawing Sheets

SUNBATHER SPRINKLER APPARATUS

RELATED APPLICATION AND DISCLOSURE DOCUMENT

This application is a continuation-in-part application of my copending application Ser. No. 07/111,309, filed Oct. 22, 1987 entitled Florida Kool Tan Sprayer, now abandoned, and the Disclosure Document No. 168284 dated Apr. 13, 1987.

BACKGROUND OF THE INVENTION

1. FIELD OF THE INVENTION

The present invention relates to sprinkling devices for use in sunbathing and particularly to sprinkling devices used in conjunction with lawn chairs or recliners.

2. PRIOR ART

There are many devices for providing a water spray onto the body of a person while sunbathing. Some of these devices utilize a mat that is placed on the ground which has a length of hose or tubing along one side. See, for example, U.S. Pat. No. 4,648,143. This device has the disadvantage of providing no method for removing the sprayed water and, in addition, the water spray comes from only one side and is not uniform over the body of a user.

A water spray that is directed from both sides of the device is disclosed in U.S. Pat. Nos. 4,548,357; 3,688,775; and 2,770,812. The '812 device comprises a horizontal structure resembling a rectangular trampoline or cot with a water spray from two long sides. The '775 device is an inflatable container with sprinkler apertures around a major portion of the upper periphery. The user will lay on a cushion within the container. The '357 device comprises a U-shaped length of flexible hose attached to a lawn chair with sprinkler apertures in the legs of the hose. The disadvantage of these three devices include the fact that water is controlled by a valve that is rotated open in the usual manner. This may be satisfactory for a user that desires a continuous water flow or for a person who only infrequently will open the valve. In addition, the '357 device suffers from the disadvantage of having water flow into the U-shaped length of hose which is capped at the end. As understood in the art, friction losses can reduce the water pressure in the lower portion resulting in an uneven spray of water.

What is desirable in a sunbathing and water sprinkling apparatus is an even spray that is easy to control. The present invention uses a spring-biased ball valve which is opened by pulling on a lanyard. Accordingly, a user can simply pull on the lanyard to open the valve. By releasing the lanyard the valve instantly closes. This apparatus allows a user to provide a short burst of spray to chase away insects and/or supply a slight cooling spray. The sprinkler apertures are drilled into two lengths supplied from a common T-connector thus providing equal water pressure to both sides at the same time. The present invention not only supplies a more even spray than the devices disclosed in the art but allows for a very fine level of spray control through a spring-biased ball valve that closes instantly upon the release of the lanyard. Also, the ball valve is located slightly above and behind the head of the user with the lanyard to the side. The user need not change position to operate the valve as is the case with the other devices in the art. Finally, the preferred embodiment of the present invention utilizes flexible hose sections that allow the use of the device with lawn chairs having adjustable head rest and leg rest portions. The other devices in the prior art are essentially rigid in form.

The present invention provides substantial improvements over the prior art with respect to its use with adjustableposition chairs, with respect to the level of control over the water flow and ease of use, and with respect to providing a balanced, even spray of water to the body of the user. None of the devices in the prior art are satisfactory as a sprinkler system to accompany sunbathing.

SUMMARY OF THE INVENTION

In accord with several aspects of the present invention, there is provided a sprinkler apparatus for use by sunbathers attachable to a lawn chair or recliner which has oppositely disposed head and foot end portions, and the apparatus includes a pair of elongated hollow tubular legs each having a first open end and a second closed end adjacent a foot end portion. Each leg has a plurality of spaced water-emitting sprinkler passageways communicating between the hollow of the legs and outwardly thereof. Connection means attaches the first open end of each of the legs to a single source of pressurized water. The connection means includes valve means for controlling the passage of water into the legs, and selective means for operating the valve means between a first closed position and a second open position, and selective means includes a pivotal handle located above a head end portion. Each sprinkler passageway includes an axis which is inclined inwardly from a vertical axis passing through each of the legs for directing the water inwardly toward the other leg. The connection means includes a three-part T-connector having a neck forming an inlet for pressurized water and two outlet ends and the first open ends of the legs are attached respectively to one of the outlet ends. The selective means further includes a lanyard attached to the handle which will move the valve means to the second position when the lanyard is tensioned and a spring attached to the handle for moving the valve means to the first position after release of tension on the lanyard.

Additional aspects are seen wherein stop means provide limits to the pivotal movement of the handle to 90°. The stop means includes a first boss on the connection means and a second boss on the handle, and the spring provides tension on the handle to position the second boss in contact with the first boss to maintain the valve means in the fully closed position. A third boss on the connection means contacts a fourth boss on the handle when the lanyard has been tensioned to open the ball valve. The third and fourth bosses are positioned with respect to the pivotal axis of the ball valve to limit the pivotal travel of the handle to position the ball valve fully open when the lanyard is tensioned.

Further aspects are provided in constructing the valve means as a ball valve which is mounted within the connection means. The ball valve is operated by the handle which has a first arm and a second arm with the lanyard attached to the first arm and the spring attached to the second arm.

An important provision is seen wherein one or two flexible tubular members are in each leg to allow the legs to be bent to conform to movement of a head portion and/or a foot portion of a lawn chair or recliner. Generally, the portions of each leg adjacent the flexible members are rigid sections. Each leg has a rigid 90° bend adjacent the first open end and forms a U-shaped configuration when the first open ends are attached to the connection means. The use of a pair of flexible members in each leg allows a foldable lawn chair to be folded in a compact manner with a head and foot end portion being located adjacent a body portion therebetween.

BRIEF DESCRIPTION OF THE DRAWINGS

The novel features which are believed to be characteristic of this invention are set forth with particularity in the appended claims. The invention itself, however, both as to its organization and method of operation, together with further objects and advantages thereof, may best be understood by reference to the following description taken in connection with the accompanying drawings, in which:

DETAILED DESCRIPTION OF THE PREFERRED EMBODIMENT

Figure 1:
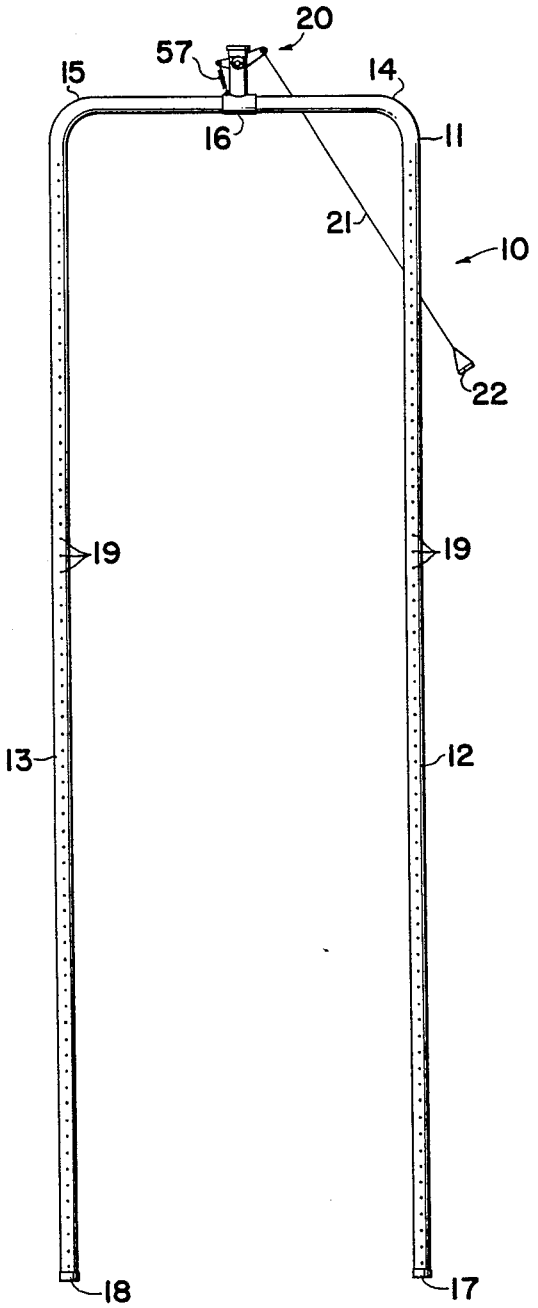
FIG. 1 is a top plan view of the sunbather sprinkler apparatus in accord with the present invention.

Referring now to the drawings, the sunbather sprinkler apparatus in accord with the present invention is depicted by the numeral 10 in FIG. 1. A generally U-shaped arrangement of sprinkler tubing 11 is comprised of two legs 12 and 13 with 90° angled sections 14 and 15, respectively, formed by bending as understood in the art. A swivel, hose-threaded T-connector 16 is used to connect the legs 12 and 13 to a supply of water (not shown). The legs 12 and 13 terminate on the other end by way of caps 17 and 18, respectively. Sprinkler holes 19 are drilled in legs 12 and 13 and are aligned to be about 16° inward of top dead center in order to direct water inwardly on a sunbather positioned within the space defined by legs 12 and 13. Water to the legs 12 and 13 enters T-connector 16 and is controlled by operating valve handle 20 via lanyard 21 with end handle 22.

Figure 2:
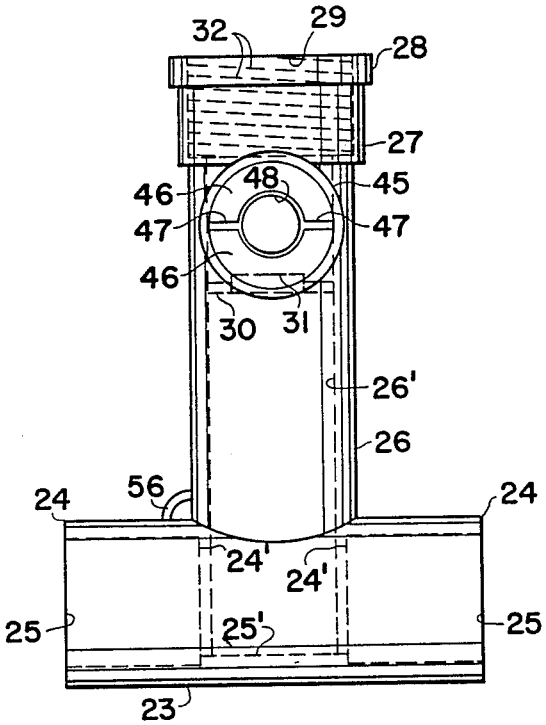
FIG. 2 is a front elevation view of the T-connector used in FIG. 1.
Figure 3:
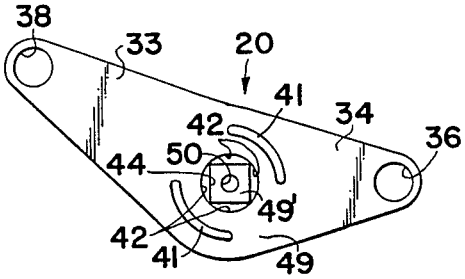
FIG. 3 is a rear elevational view of the valve handle used in FIG. 1.
Figure 4:
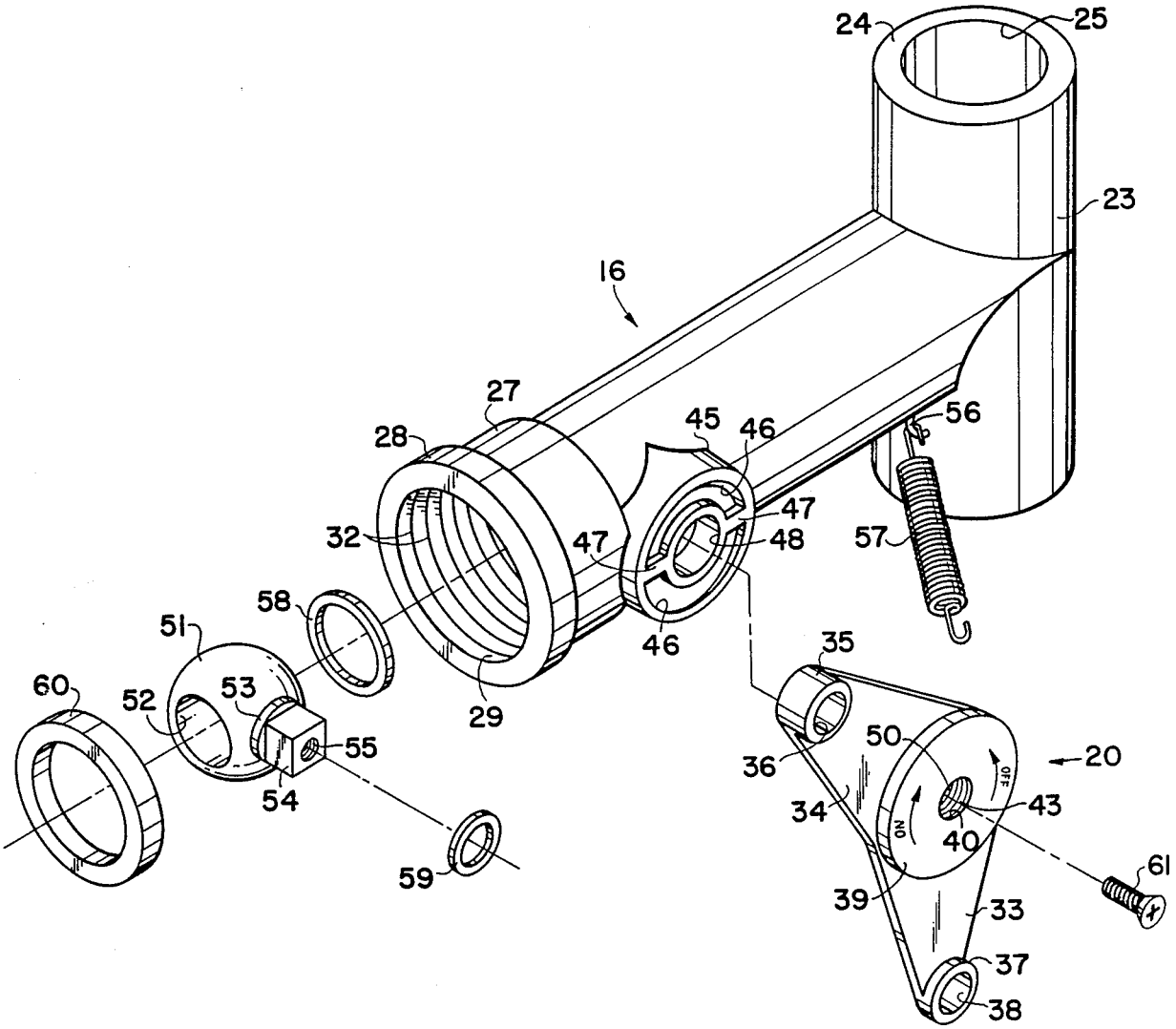
FIG. 4 is an exploded isometric view of the T-connector, ball valve and valve handle used in FIG. 1.

With reference now to FIG. 2, the T-connector 16 is illustrated. The T-connector 16 is comprised of lower horizontal section 23 with opposing ends 24 with outlet openings 25. The upper angled sections 14 and 15 fit within openings 25 to a limit established by interior circular flanges 24' as understood in the art. The wall thickness of angled sections 14 and 15 should be such that the sections 14 and 15 fit smoothly against flanges 24' and central boss 25' in order to reduce internal friction and the potential for collecting debris in any spaces that might otherwise be present. Sections 14 and 15 are secured into ends 24 by glue or other appropriate means. The T-connector 16 also includes vertically disposed neck 26 with interior walls 26' defining a water passageway therethrough. A swivel connection 27 has a flange member 28 with inlet opening 29. Threads 32 are formed to match the exterior threads on an ordinary garden hose. The interior walls 26' of neck 26 include a circular boss 30 formed to provide a circular ball valve seat 31. In FIG. 3 the operating lever handle 20 is illustrated. The handle 20 is preferably formed from a single piece of plastic molded to include arms 33 and 34 of unequal length. Openings 36 and 38 are formed within arms 34 and 33 respectively, having upraised bosses 35 and 37 respectively, as clearly shown in FIG. 4. The rear side of handle 20, as illustrated in FIG. 3, has two arcuate upraised bosses 41 which each occupy 90° of arc. Four upraised bosses 42 define a rectangular socket 44. As illustrated in FIG. 4, handle 20 also has an upraised boss 39 on the front side with a screw hole 40 countersunk to surface or ridge 43 therein.

With reference again to FIG. 2, a valve handle fitting 45 is formed onto the surface of neck 26 and has guide spaces 46 into which arcuate bosses 41 ride and diametrically aligned bosses 47 which contact the bosses 41 to limit pivotable movement of the handle 20 as more fully described below. Handle fitting 45 has opening 48 for valve operating apparatus which will also be described below. The rear side of handle 20 is positioned onto the fitting 45 by placing handle surface 49 against the fitting 45. That part of surface 49 contained within socket 44 is defined as socket base 49'. Screw hole 50 is drilled through handle 20.

With reference to FIG. 4, the assembly of the handle and valve operating apparatus can be explained. Ball valve 51 has an opening 52 therethrough and a boss 53 mounted thereon. Valve operating arm 54 is a generally cubicle block with a screw hole 55 formed therein and is glued onto boss 53. Alternatively, the valve 51, boss 53 and operating arm 54 may be molded as a single unit.

Ball valve 51 is installed in neck 26 in a manner to position operating arm 54 within the opening 48 of handle fitting 45. The ball valve 51 will rest against seat 31. Handle 20 is placed against fitting 45 in a manner to force operating arm 54 into socket 44. Screw hole 50 is thereby aligned with screw hole 55. Opening 40 in handle 20 is sized to accept the head diameter of screw 61 which has a travel limit defined by the ridge surface 43 of opening 40. 0-ring 58 prevents leakage around seat 31 and 0-ring 59 prevents leakage around operating arm 54. Gasket 60 prevents leakage from a pressurized garden hose around threads 32 as understood in the art. With screw 61 installed, movement of the valve handle 20 will pivot the valve 51 through a 90° turn between the fully open and fully closed positions. Arcuate bosses 41 fit with guides 46 and accordingly bosses 47 will limit the rotational movement of handle 20. Spring 57 is connected between opening 38 on arm 33 and spring connection 56. The alignment of arm 33 with spring 57 attached between opening 38 and spring connection 56 is such that the valve 51 is normally biased closed. Lanyard 21 is tied through opening 36 in arm 34. When the lanyard 21 is pulled by grasping handle 22 the ball valve will rotate 90° to the fully open position and remain open only so long as tension is maintained on lanyard 21. When lanyard 21 is released, the bias of spring 57 will cause the ball valve 51 to immediately close. As understood in the art, the long arm 33 of handle 20 reduces the strength requirements of spring 57.

Figure 5:
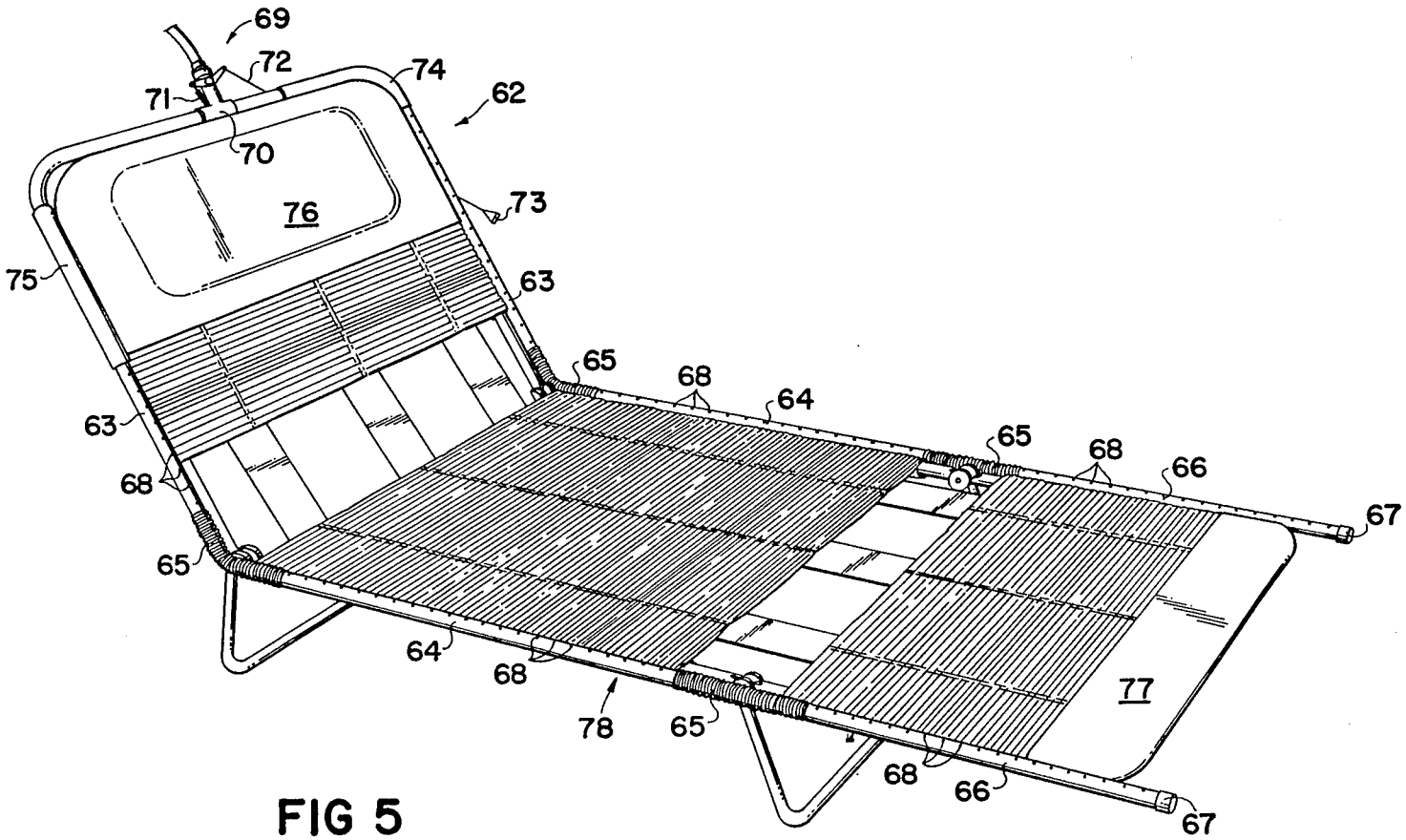
FIG. 5 is a perspective view of the preferred embodiment of the sprinkler apparatus in accord with the present invention attached to an adjustable and/or foldable lawn chair.

With reference now to FIG. 5, the preferred embodiment of the sprinkler apparatus is illustrated. The sunbather sprinkler apparatus 62 is comprised of identical lengths of drilled PVC pipe forming two legs 63. Four identical 5 inch long flexible tubular PVC pipe connectors 65 are used to connect sections 64 to legs 63 and sections 64 to lower leg sections 66 which terminate with caps 67. Drilled sprinkler holes 68 comprise passageways with an axis aligned inwardly of a vertical axis through top dead central to direct water inwardly. Control of incoming water is accomplished via valve apparatus 69 which preferably is identical to the handle 20 and ball valve 51 assembly fully described above. T-connector 70 is identical to connector 16 and spring 71 biases the valve apparatus to the normally fully closed position. Water is supplied by pulling on lanyard 72, which has handle 73.

Flexible pipe sections 65 allow the sprinkler apparatus 62 to be secured to and bend with a lawn chair 78 having both an adjustable back and/or head rest 76 and an adjustable leg and/or foot rest 77. The flexible sections 65 are illustrated as being of equal length but unequal lengths could be used with particular chairs that may require same. Sprinkler apparatus 62 can be secured to lawn chair 78 via a plurality of spaced plastic lock ties, for example. The use of flexible pipe sections 65 also allow the chair 78 to be folded in a compact manner for storage without removal of the apparatus 62.

In operation a sunbather can simply pull lanyard 21 or 72 to be supplied with a cooling spray whenever desired. As long as lanyard 21 or 72 has sufficient tension on it supplied by the sunbather, the ball valve 51 will open fully or partially, and the spray will continue. The water spray will immediately cease when the lanyard 21 or 72 is released by the return spring 71 biasing valve 51 closed. This feature, in addition to the placement of the inlet apparatus 70 slightly above the user's head thus positioning the lanyard 72 near the operator's hand, results in control of the water spray and operator convenience that is simply not present with other sprinkler apparatus known in the art.

A further level of spray control is derived from the use of slidable water blocking sleeves 74 and 75 illustrated in FIG. 5. Sleeves 74 and 75 are hollow tubular members that fit over legs 63 for covering sprinkler holes 68. This feature allows a sunbather to cover the holes 68 to prevent water from being sprayed onto the user's hair, face or neck as may be desired. The sleeves 74 and 75 may be permanently mounted onto the rigid upper elbow portions of legs 63 during assembly of the sprinkler apparatus 62. Alternatively, sleeves 74 and 75 may be constructed of plastic or rubber members that are split longitudinally and can simply be forced over legs 63 as understood in the art. Preferably, sleeves 74 and 75 are sized to be slidable over flexible sections 65 or removable so that the sleeves 74 and 75 can be positioned at any place desired on sprinkler apparatus 62 including a stored position adjacent connector 70.

While the invention has been described with respect to certain specific embodiments, it will be appreciated that many modifications and changes ma be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

I claim:

1. A sprinkler apparatus for use by sunbathers attachable to a lawn chair or recliner having oppositely disposed head and foot end portions comprising a pair of elongated hollow tubular rigid legs each having a first open end and a second closed end adjacent a foot end portion, each said leg including an inperforate angled section carrying said open end and being adjacent the head portion and a body section extending between said angled section and said closed end, said angled sections extending generally horizontally and in opposed directions to space said body sections apart, said body sections extending substantially parallel to each other and being adapted to be disposed on either side of a sunbather disposed on a lawn chair or recliner, said closed ends being located in alignment with respective said body sections of said legs, each said body section of said leg having a plurality of spaced water-emitting sprinkler passageways communicating between the hollow of said legs and outwardly thereof, connection means located substantially medially of and between said angled sections for connecting said first open end of each of said angled section to a single source of pressurized water, said connection means including valve means for controlling the passage of water into said legs, selective means for operating said valve means between a first closed position and a second open position, said selective means including a pivotal handle located above a head end portion.

2. In the sprinkler apparatus as defined in claim 1 wherein said connection means includes a three-part T-connector having a neck forming an inlet for pressurized water and two outlet ends, said first open ends of said legs being attached respectively to one of said outlet ends.

3. In the sprinkler apparatus as defined in claim 1 wherein said selective means further includes a lanyard attached to the said handle, said handle moving said valve means to said second position when said lanyard is tensioned.

4. In the sprinkler apparatus as defined in claim 3 wherein said selective means further includes a spring attached to said handle for moving said valve means to said first position after release of tension on said lanyard.

5. In the sprinkler apparatus as in claim 1 wherein each said sprinkler passageway includes an axis which is inclined inwardly from a vertical axis passing through each of said legs for directing the water inwardly toward each said leg.

6. In the sprinkler apparatus as defined in claim 1 wherein said selective means further includes stop means for limiting the pivotal movement of said handle to 90°.

7. In the sprinkler apparatus as defined in claim 1 wherein said body sections of said legs each further includes a flexible tubular member adjacent the head portion to allow said body sections of legs to be bent to conform to movement of a head portion of a lawn chair or recliner.

8. In the sprinkler apparatus as defined in claim 4 wherein said selective means further includes stop means for limiting the pivotal movement of said handle to 90°, said stop means including a first boss on said connection means and a second boss on said handle, said spring providing tension on said handle to position said second boss in contact with said first boss to maintain said valve means in the fully closed position.

9. In the sprinkler apparatus as defined in claim 8 wherein said stop means further includes a third boss on said connection means and a fourth boss on said handle, said fourth boss contacting said third boss when said lanyard has been tensioned to open said ball valve, said third and fourth bosses being positioned with respect to the pivotal axis of said ball valve to limit the pivotal travel of said handle to position said ball valve fully open when said lanyard is tensioned.

10. In the sprinkler apparatus as defined in claim 1 wherein said valve means is a ball valve, said ball valve being mounted within said connection means.

11. In the sprinkler apparatus as defined in claim 4 wherein said handle includes a first arm and a second arm, said lanyard attached to said first arm, said spring attached to said second arm.

12. In the sprinkler apparatus as defined in claim 2 wherein said valve means is a ball valve mounted in said neck of said T-connector.

13. In the sprinkler apparatus as defined in claim 1 wherein each body section of said leg includes a pair of spaced flexible tubular members to allow said body sections of said legs to be bent to conform to movement of a head portion and a foot portion of a lawn chair or recliner.

14. In the sprinkler apparatus as defined in claim 1 wherein each said angled section of said leg has a 90° bend adjacent said first open end, said angled sections and body sections of said legs being formed in a U-shaped configuration.

15. In a sprinkler apparatus for use by sunbathers positioned on a lawn chair having a head and foot end portion and a body portion therebetween, said apparatus comprising a pair of elongated hollow and rigid tubular legs each having a first open end and a second closed end adjacent a foot end portion, each said leg including an inperforate angled section carrying said open end and being adjacent the head portion and a body section extending between said angled section and said closed end said angled sections extending generally horizontally and in opposed directions to space said body sections apart, said body sections extending substantially parallel to each other and being adapted to be disposed on either side of a sunbather disposed on a lawn chair or recliner, said closed ends being located in alignment with respective said body sections of said legs, each said body section of said leg having a plurality of spaced water-emitting sprinkler passageways communicating between said hollow and outwardly thereof, connection means located substantially medially of and between said angled sections for connecting said angled section to a single source of pressurized water, valve means for controlling the passage of water into said legs, selective means for operating said valve means between a first closed position and a second open position, spring means for biasing said valve means closed.

16. A sprinkler apparatus as defined in claim 15 further comprising a pair of spaced flexible members in each said said body section of leg adjacent respective said head and foot end portions whereby the angular positioning thereof may be adjusted and a foldable lawn chair may be folded in a compact manner with a head and foot end portion being located adjacent a body portion thereof.

17. A sprinkler apparatus for use by sunbathers attachable on an adjustable-position lawn chair having a head and foot end portion, comprising a pair of elongated hollow tubular rigid legs each having a first open end and a second closed end adjacent a foot end portion, each said leg including a first rigid inperforate elbow section adjacent said first open end, a body portion including a second rigid section connected at one end of said first rigid elbow, a third flexible inperforate section connected at one end to the other end of said second section, a fourth rigid section connected at one end to the other end of said third section and including at the other end said second closed end, said elbow sections extending generally laterally and in opposed direction to spaced said body portions apart, said body portions extending substantially parallel to each other and being adapted to be disposed on either side of a sunbather disposed on an adjustable position lawn chair, said closed ends being located in alignment with respective said body portions of said legs; said second and fourth rigid sections having a plurality of water-emitting sprinkler passageways communicating between the hollow of said leg and outwardly thereof, said third flexible sections being positioned adjacent a head end portion of a lawn chair for allowing said legs to be bent in the vertical direction to conform to angular positioning of a head end portion, connection means located substantially medially of and between said elbow section adjacently above a head end portion of a lawn chair for attaching each elbow section of said leg to a single source of pressurized water, valve means for controlling the passage of water through said connection means into said legs, selective means for operating said valve means between a first closed position and a second open position, said selective means including a rotatable handle operatively coupled to said valve means and securing means for removably attaching said legs to a lawn chair.

18. In the sprinkler apparatus as defined in claim 17 wherein said fourth rigid sections each include a flexible portion intermediate of the length thereof to allow said fourth sections to be bent vertically to conform to angular positioning of a foot end portion.

19. In the sprinkler apparatus as defined in claim 17 wherein said valve means includes a ball valve mounted in said connection means and extension means attached to said handle for convenient operation of said handle by a user lying on a lawn chair.

20. In the sprinkler apparatus as defined in claim 17 further comprising spring means for normally maintaining said valve means closed and for returning said valve means to a closed position after release of said handle by a user.

21. In the sprinkler apparatus as defined in claim 17 further including a pair of slidable and flexible sleeves being positionable on said second and fourth rigid sections for selectively blocking the flow of water through said sprinkler passageways and being further positionable on said first rigid elbows to expose said sprinkler passageways in said second and fourth rigid sections.

* * * * *